US006648496B1

(12) United States Patent
Elghoroury et al.

(10) Patent No.: US 6,648,496 B1
(45) Date of Patent: Nov. 18, 2003

(54) NIGHTLIGHT WITH LIGHT EMITTING DIODE SOURCE

(75) Inventors: Hesham M. Elghoroury, Solon, OH (US); Edward J. Thomas, Streetsboro, OH (US); Wordell Nelson, South Euclid, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/604,467

(22) Filed: Jun. 27, 2000

(51) Int. Cl.[7] ..... F21V 7/04

(52) U.S. Cl. ..... 362/555; 362/800; 362/183; 362/184; 362/95; 362/147; 362/249; 362/576; 362/84; 362/295

(58) Field of Search ..... 362/555, 800, 362/183, 184, 95, 147, 249, 576, 84, 295

(56) References Cited

U.S. PATENT DOCUMENTS

| | | | | | |
|---|---|---|---|---|---|
| 864,561 | A | * | 8/1907 | Spira et al. | 111/57 |
| 4,255,780 | A | * | 3/1981 | Sakellaris | 362/32 |
| 4,947,291 | A | * | 8/1990 | McDermott | 359/501 |
| 5,473,517 | A | * | 12/1995 | Blackman | 362/95 |
| 5,495,402 | A | * | 2/1996 | Houssian | 362/226 |
| 5,637,930 | A | * | 6/1997 | Rowen et al. | 307/112 |
| 5,806,961 | A | * | 9/1998 | Dalton et al. | 362/183 |
| 5,813,752 | A | | 9/1998 | Singer et al. | 362/293 |
| 5,813,753 | A | | 9/1998 | Vriens et al. | 362/293 |

* cited by examiner

*Primary Examiner*—Sandra O'Shea
*Assistant Examiner*—Bertrand Zeade
(74) *Attorney, Agent, or Firm*—Fay, Sharpe, Fagan, Minnich & McKee, LLP

(57) ABSTRACT

A series of light emitting diodes (LEDs) are mounted within a housing (10) and operate as the light source for a nightlight. One LED (26) is positioned at each of the four corners of the housing forming an array of LEDs which generates an LED emitted light. The LEDs are all interconnected through printed wiring (40) mounted within the housing. Power is provided to each of the LED's through the printed wiring which is coupled to a power source. The power source can be a battery assembly (160), an electrical outlet or an energy storage device. An adjustable switch (50) is disposed on an exterior surface of the wall plate and is coupled to a variable resistor enclosed by the housing. The switch permits control over the optical output.

22 Claims, 5 Drawing Sheets

NIGHTLIGHT WITH LIGHT EMITTING DIODE SOURCE

BACKGROUND OF THE INVENTION

1. Field of the Invention

This invention pertains to an apparatus for improving the performance of nightlights by providing a longer lighting life and higher efficacy. More particularly, the invention relates to improving nightlight performance by replacing a standard incandescent miniature lamp found in conventional nightlights with a light emitting diode (LED).

2. Discussion of the Art

Conventional nightlights often utilize miniature incandescent lamps as a light source. Incandescent lamps are generally fragile and have a relatively short operating life, thereby giving users the trouble of frequently replacing a failed bulb. Furthermore, filament lamps are not the most economical light source. These lamps have numerous components making them relatively expensive to manufacture and have a relatively high power consumption-to-light output ratio.

Light Emitting Diodes (LEDs) have made significant advances in providing a higher performing light source since their inception in the 1960's. In the 1980's, red-emitting AlGaAs LEDs were developed with external quantum efficiencies greater than 10%, such devices being more energy efficient and longer lasting producers of red light than red-filtered incandescent bulbs. As a result, LEDs have become cost effective replacements for standard incandescent light sources in various applications, such as automotive brake lights. Moreover, high-efficiency LEDs have been developed and are commercially available in the blue and blue/green wavelength range based on the InGaN and AlGaN material systems. Most recently, LEDs have been developed in the green and yellow color range with an external quantum efficiency greater than 1%.

The advent of UV and blue LEDs allowed the possibility to generate white light from an LED by applying luminescent phosphor materials on top of the LED. This layer of phosphor partially transforms the UV or blue light into longer wavelengths, e.g. yellow light. Successful implementation of such a device is dependent upon the efficient conversion of UV/blue light into visible light of the desired wavelength and the subsequent efficient extraction of the generated visible light from the device. However, the first commercially available white light LED systems were not competitive with standard light sources with respect to performance since the phosphor layer only partially transformed the UV or blue light into longer wavelengths. Not until recently have devices and methods been developed for efficiently converting UV/blue light into visible light. A detailed disclosure of a UV/blue LED-Phosphor Device with efficient conversion of UV/blue Light to visible light may be found in U.S. Pat. No. 5,813,752 (Singer) and U.S. Pat. No. 5,813,753 (Vriens).

White-light LED systems provide significant benefits over traditional incandescent lamps. As white light producing LED systems become more refined and efficient, a need exists to expand the use of such systems into others areas, such as the art of night-lights. As discussed above, the current incandescent lamps used for nightlights have various drawbacks. Constructing a nightlight with an LED as its light source would alleviate most, if not all, of the foregoing problems. To date, no device exists which adequately utilizes an LED system in nightlights. Therefore, it would be advantageous to provide an LED light source for nightlights which replaces the traditional filament lamp with an LED light source.

BRIEF SUMMARY OF THE INVENTION

A new and improved apparatus is provided for improving the performance of nightlight systems by replacing the miniature incandescent lamps found in conventional nightlights with a light emitting diode.

A nightlight assembly includes a housing. A protective cover encloses at least a portion of the housing. At least one light emitting diode (LED) is mounted within the housing, which generates an LED beam and serves as the light source for the nightlight.

A nightlight assembly includes a wall plate adapted to fit over a switch plate extending from a substantially planar surface. The wall plate engages and abuts the substantially planar surface upon mounting the nightlight in its final operating position. At least one light emitting diode (LED) is mounted within the wall plate which serves as the light source for the nightlight.

One advantage of the present invention is the provision of a nightlight having a longer life and increased reliability.

Another advantage of the present invention resides in the reduced cost of manufacturing a nightlight due to the decreased number of required components.

Another advantage of the present invention is the ability to more precisely control light emitted from the nightlight.

Another advantage of the present invention is the provision of a nightlight having a minimal cost of operation due to the inherently low power consumption of the nightlight.

Yet another advantage of the present invention is the provision of a switch coupled to a variable resistor which allows control over the intensity of optical output and the number of LEDs in operation.

Yet another advantage of the present invention is the provision of a battery-powered nightlight which allows for a more desirable placement of the nightlight.

Still other benefits and advantages of the invention will become apparent to those skilled in the art upon a reading and understanding of the following detailed specification.

DETAILED DESCRIPTION OF THE INVENTION

Figure 1:
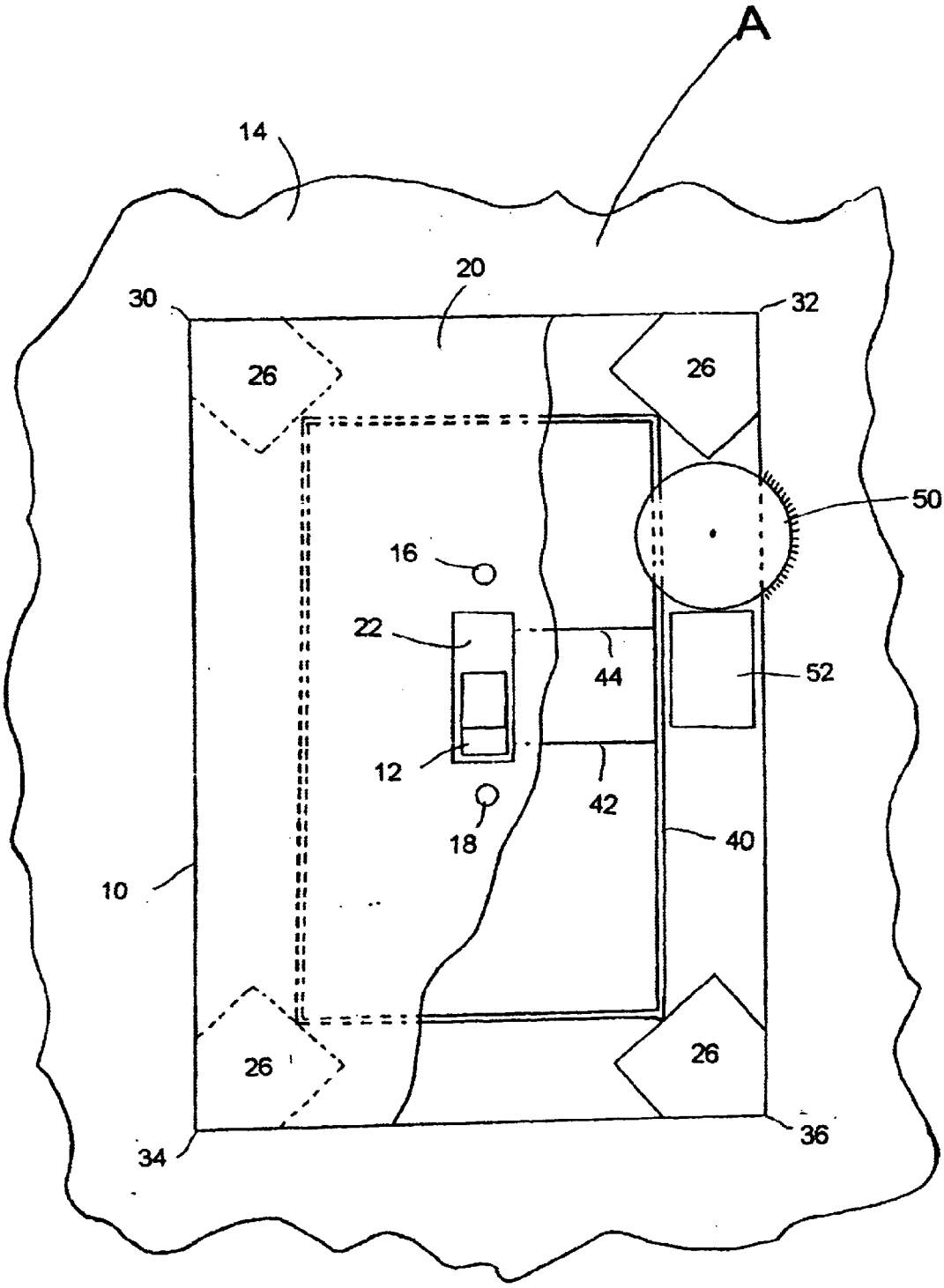
FIG. 1 is a front partially broken away view of a nightlight in accordance with a first embodiment of the present invention.

FIG. 1 shows a nightlight A in accordance with an exemplary embodiment of the present invention. The nightlight includes a substantially rectangular wall plate 10, preferably having a thin profile, adapted to fit over a power switch 12 extending from a planar surface, such as a wall 14. The wall plate has a mounting arrangement for securing the nightlight to the planar surface. In the illustrated embodiment, two apertures 16, 18, located on a front surface 20 of the wall plate receive fasteners, such as screws. It will be appreciated that any conventional wall plate and mounting arrangement is within the scope and intent of the present invention.

In order to allow the wall plate to fit over the power switch, the wall plate 10 has a switch toggle opening 22 for receiving the power switch and allowing the power switch to extend through the wall plate. Switch opening 22 has a substantially rectangular shape and is preferably located at the center of the wall plate, although opening 22 can be differently configured for receiving a different component, such as an outlet. Once the power switch has been received by the switch opening, the wall plate is mounted (via the mounting means) flush against the surface 14.

With continued reference to FIG. 1, a series of light emitting diodes, (LEDs) 26, mounted around the periphery of the wall plate 10, operate as the light source for the nightlight A. The LEDs of the present invention replace the standard miniature incandescent lamp and associated hardware that are used in conventional nightlights. In a first exemplary embodiment, one LED is positioned at each of the four corners 30, 32, 34, 36 of the rectangular wall plate 10, thus forming an array of LEDs which generate an LED output. However, the LEDs may be located at any desired location within the wall plate. The LEDs in the array can be of multiple colors of spectral output, thereby giving the desired light output, light level and beam characteristics, by which variations in beam color, distribution and dimming can be achieved.

The LED light source further includes an optical assembly, for example a reflector and/or lens, which functions to focus and disperse the LED beam to any variety of wall plate contour. The optical assembly is selectively moveable in order to affect the focus and dispersion of the LED beam as desired. Alternatively, the focus and dispersion may be adjusted by fixing the optical assembly and allowing the LED array to move or rotate. In yet another arrangement, the lens/reflector are fixed relative to the LEDs.

In order to effectively provide power to each of the LEDs 26, printed wiring 40 is molded into the wall plate 10 and interconnects all of the LEDs. The printed wiring is disposed around the periphery of the wall plate at a location inside the outermost perimeter of the wall plate. Contact wires 42, 44 extend horizontally inward from a section of the printed wiring and are coupled to the power switch. As such, when the power switch is turned off, power is transmitted from the switch, to the contact wires, through the printed wiring, and ultimately to each of the LEDs positioned around the periphery of the wall plate, thus providing illumination. When the power switch is turned on, the circuit is broken and power is no longer provided to the LEDs.

The nightlight A further includes an adjustable switch 50 disposed on the exterior of the wall plate 10 and coupled to a variable resistor 52 which permits control over the light level. The switch is preferably a rotatable thumb wheel 50 which adjusts the levels of illumination upon rotation. However, any conventional switch, such as a slidable button, lever, push button, etc. is within the scope and intent of the present invention. The switch 50 can be designed as a rheostat so that it is possible to change the resistance value without interrupting the circuit to which it is connected. As such, a user may adjust the optical output to any desired level.

Alternatively, or in addition to the rheostat design, the switch can be manufactured having step level variable control, which allows a user to choose from distinct levels of illumination. In such an embodiment, the variable resistor provides specific levels of resistance to the circuit, each level of resistance corresponding to distinct levels of illumination. In addition, the switch may be designed to enable a user to turn on and off any number of individual LEDs disposed around the wall plate.

Figure 2:
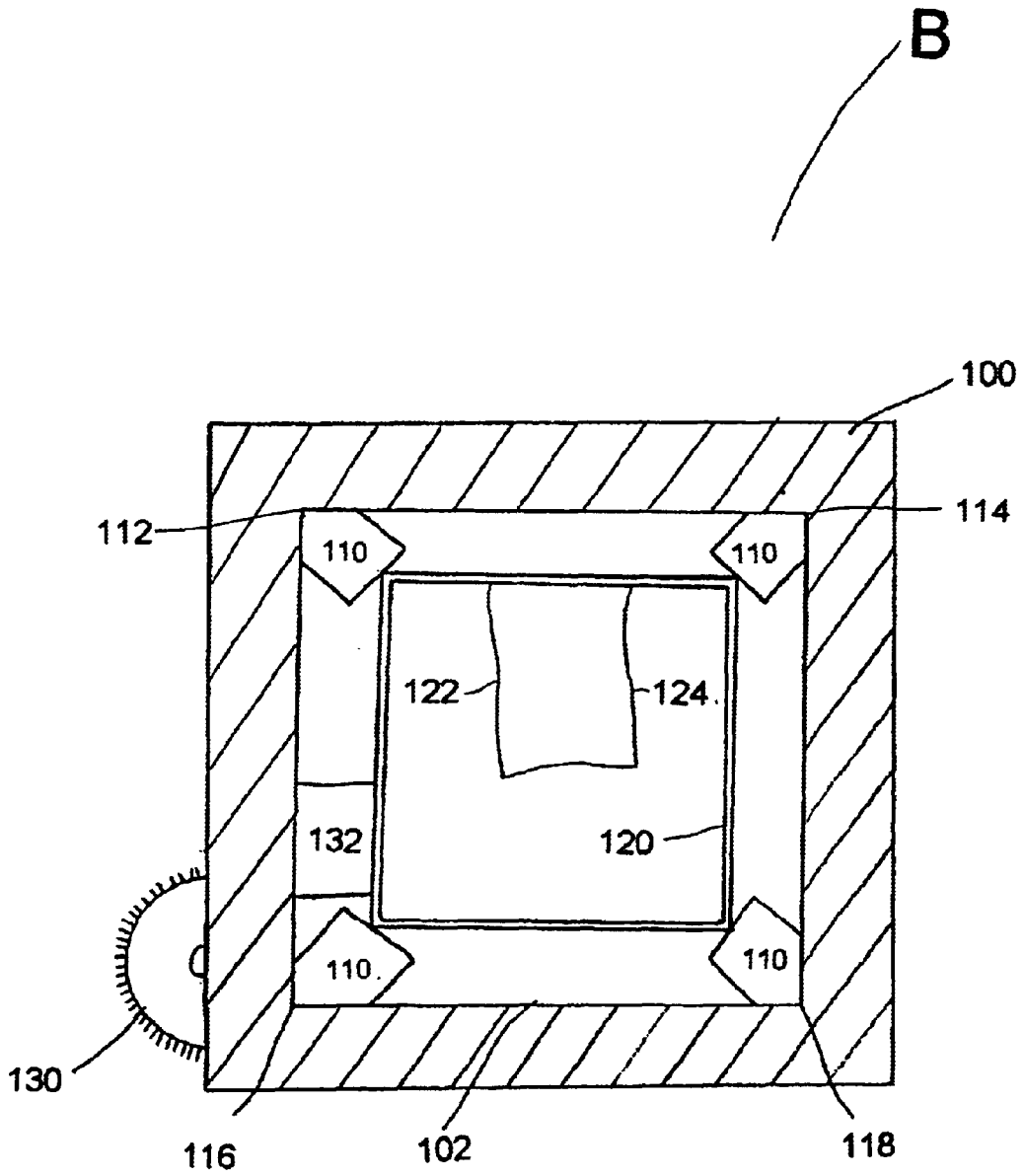
FIG. 2 is a cross-sectional view of a nightlight adapted for a plug-in mode of operation.
Figure 3:
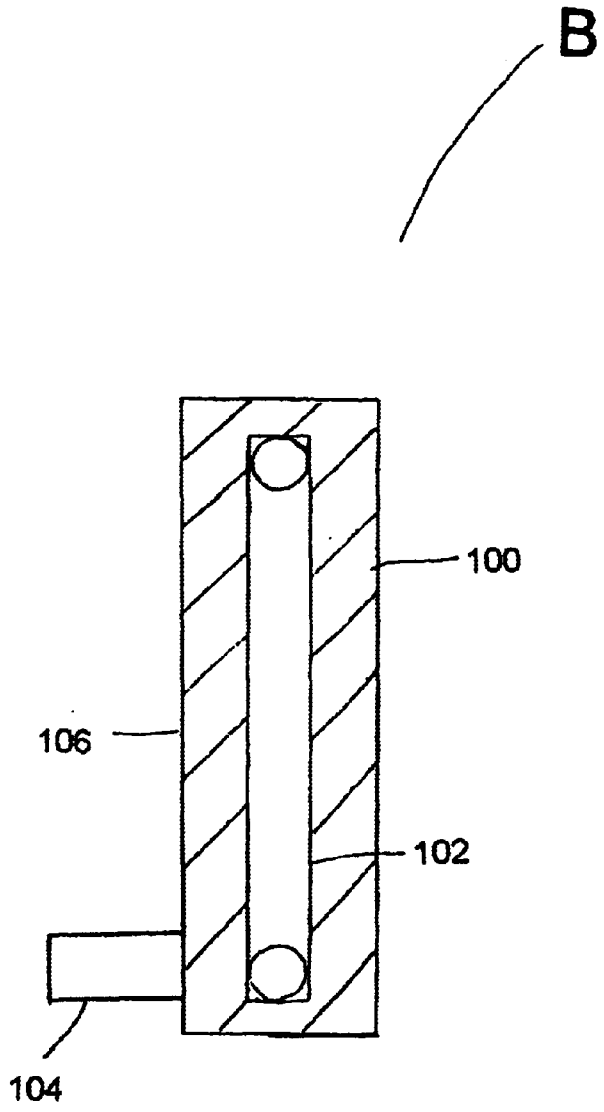
FIG. 3 is a side cross-sectional view of a nightlight adapted for a plug-in mode of operation.

Referring now to FIGS. 2 and 3, a nightlight B is shown in accordance with a second embodiment of the present invention. Unlike the first embodiment illustrated in FIG. 1, the nightlight of the second embodiment is adapted to plug into any conventional electrical outlet (not shown). The nightlight B includes a first outer housing or cover 100 enclosing at least a portion of a second inner housing 102. The outer housing has a thin profile. Prongs or contact blades 104, extending horizontally outward from a rear face 106 of the outer housing, are adapted to insert into an electrical outlet, which provides power to the nightlight.

Inner housing 102 has a series of LEDs 110 mounted around its periphery. The LEDs are positioned at each of the four corners 112, 114, 116, 118 of the inner housing thus forming an array of LEDs which operates as the light source for the nightlight. However, the LEDs may be located at any desired location within the inner housing. The LEDs in the array can be of multiple colors of spectral output, thereby giving the desired light output, light level and beam characteristics, by which variations in beam color, distribution and dimming can be achieved.

In order to effectively provide power to each of the LEDs 110, printed wiring 120 is provided in the inner housing 102 and electrically connects all of the LEDs together. The printed wiring is preferably disposed around the periphery of the inner housing at a location inside the inner housing's outermost perimeter. Contact wires 122, 124 extend from a section of the printed wiring and are coupled to the blades or prongs 104 extending from the outer housing 100. As such, when the nightlight is plugged in, power is transmitted from the prongs, to the contact wires, through the printed wiring, and ultimately to each of the LEDs positioned around the periphery of the inner housing, thus providing illumination.

The night-light B further includes an adjustable switch 130 disposed on the exterior of the outer housing 100 and coupled to a variable resistor 132 which permits control over the light level. The switch is preferably a rotatable thumb wheel 130 to change the resistance value without interrupting the circuit to which it is connected. As such, a user may adjust the optical output to any desired level. Alternatively, or in addition to the rheostat design, the switch can be designed having step level variable control, which allows a user to choose from distinct levels of illumination. In addition, the switch may be designed to enable a user to turn on and off any number of individual LEDs disposed around the periphery of the inner housing.

Figure 4:
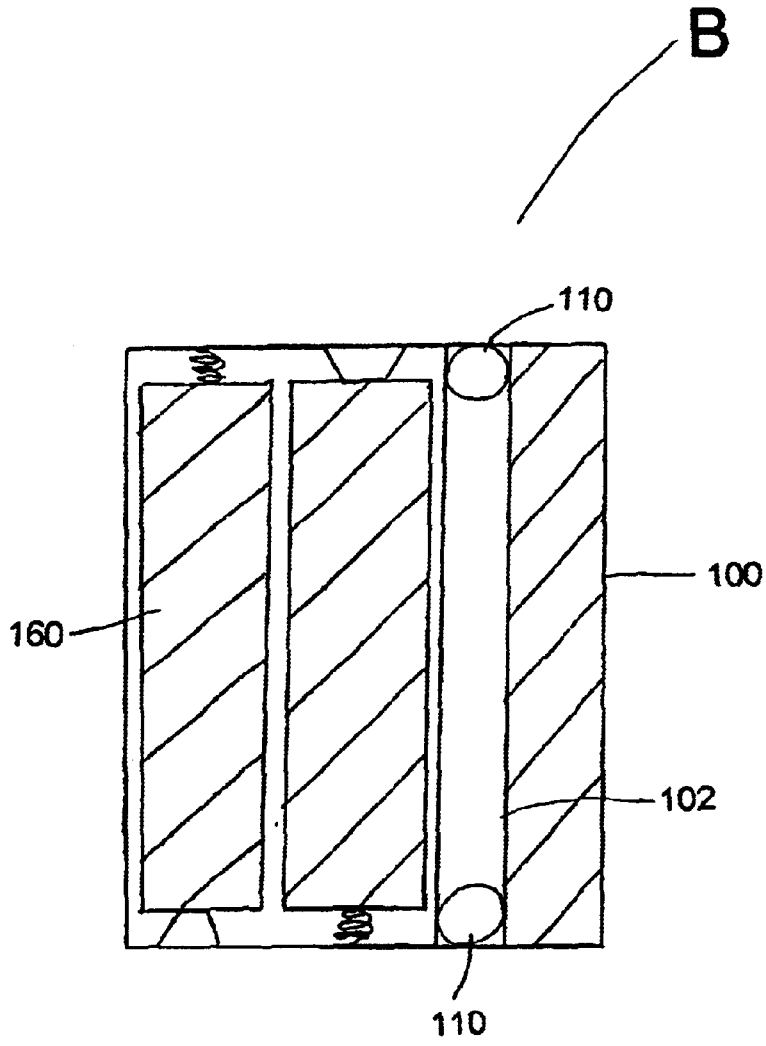
FIG. 4 is a side cross-sectional view of a battery powered nightlight.

Referring now to FIG. 4, the outer housing 100 of the nightlight B may optionally enclose a series of batteries 160. The batteries, rather than a conventional electrical outlet, operate as the power source for the nightlight. Thus, the prongs 104 shown in FIG. 3 are not necessary for effective operation of this embodiment. As such, the contact wires 122, 124 extend from the printed wiring and are coupled to the batteries instead of the prongs. Batteries 160 can be of any desired type and size.

A significant advantage of a battery operated design is that it allows for a more desirable placement of the nightlight since the nightlight is not limited for use in environments where electrical outlets are available. For example, the nightlight may be used in a car, a garage, on a table, etc. It will be appreciated by one skilled in the art that utilizing the nightlight at increased levels of illumination will decrease the life of the batteries. As such, the adjustable switch 130 can be used to control the life of the batteries. It will also be appreciated that the power source for the nightlight can be a capacitor or other energy storage means due to the inherent high efficiency of the device.

Figure 5:
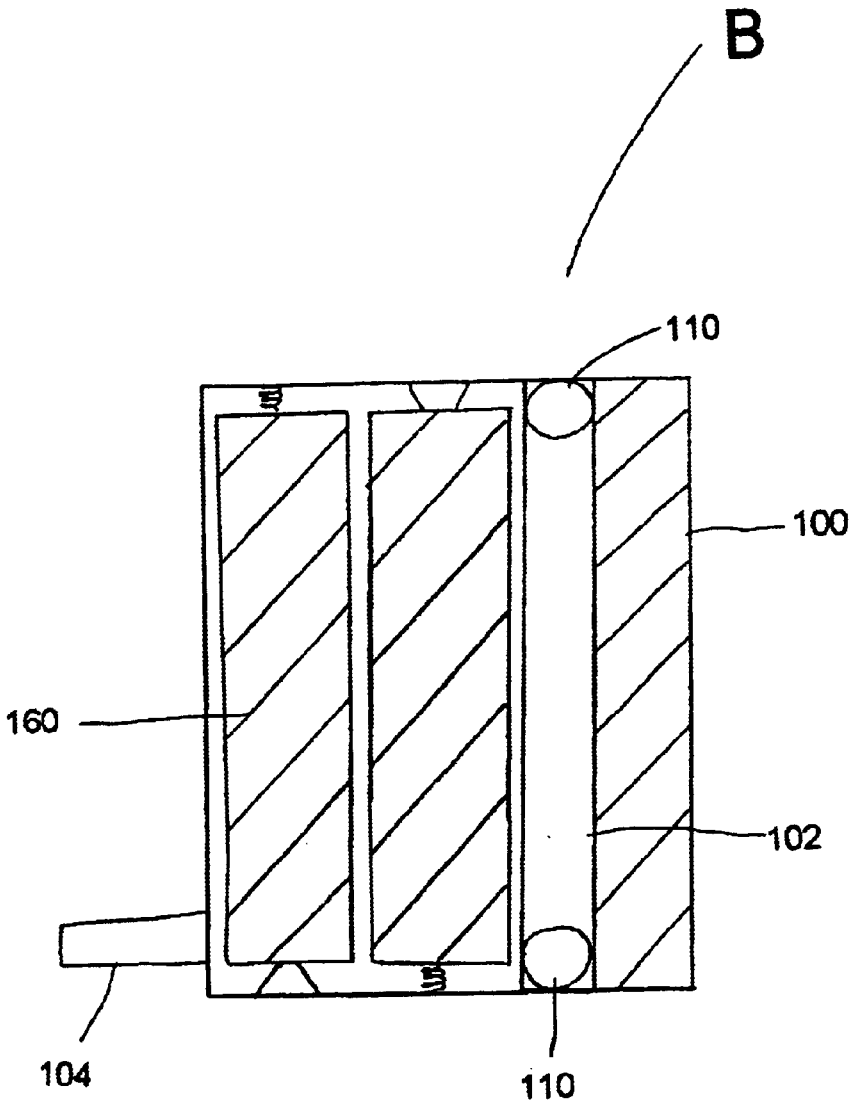
FIG. 5 is a side cross-sectional view of a dual powered nightlight.

Turning now to FIG. 5, the nightlight B may be manufactured having dual power sources. In the illustrated embodiment, the nightlight has both a battery source, comprising a series of batteries 160, and prongs 104, adapted to be plugged into an electrical outlet. Therefore, a user may choose to operate the nightlight in a battery mode or in a plug-in mode. During battery mode operation, the batteries 160 provide the necessary power to the nightlight. During plug-in mode operation, AC from the electrical outlet provides the necessary power to the nightlight. The dual power source design is ideal when AC power is unavailable or has failed such as during a power outage. In a preferred embodiment, the batteries function to automatically turn on the nightlight upon failure of the power being supplied by the electrical outlet.

The invention has been described with reference to the preferred embodiment. Obviously, modifications and alterations will occur to others upon a reading and understanding of this specification. The invention is intended to include all such modifications and alterations in so far as they come within the scope of the appended claims and the equivalents thereof.

What is claimed is:

1. A nightlight assembly comprising:

a housing;

a protective cover including an optical assembly for focusing and dispersing LED emitted light to a desired light contour enclosing at least a portion of the housing; and at least one light emitting diode (LED) mounted within the housing generating an LED beam and serving as the light source for the nightlight.

2. The nightlight assembly according to claim 1, wherein the optical assembly is selectively adjustable for focusing and dispersing the LED emitted light as desired.

3. The nightlight assembly according to claim 1, wherein the optical assembly is fixed and the LED serving as the light source is selectively moveable for focusing and dispersing the LED emitted light as desired.

4. The nightlight assembly according to claim 1, further comprising a set of prongs extending outward from a surface of the protective cover adapted to insert into an electrical outlet.

5. The nightlight assembly according to claim 1, wherein a plurality of LEDs are mounted within the housing having multiple colors of spectral output.

6. The nightlight assembly according to claim 1, further comprising printed wiring molded into the housing electrically coupling the LED to a power source.

7. The nightlight assembly according to claim 1, further comprising a switch coupled to a variable resistor for controlling the level of optical output.

8. The nightlight assembly according to claim 7, wherein the switch is adapted to selectively turn on and off any select number of the at least one LED.

9. The nightlight assembly according to claim 7, wherein the switch operates as a step level variable control having at least two distinct levels of illumination.

10. The nightlight assembly according to claim 7, wherein the switch operates as a rheostat having continuous variable control.

11. The nightlight assembly according to claim 1, wherein the protective cover encloses a battery source which operates as the power source for the nightlight.

12. The nightlight assembly according to claim 1, wherein the nightlight has both a battery mode of operation and a plug-in mode operation, the battery mode of operation utilizing a battery source for power, and the plug-in mode of operation utilizing a set of prongs adapted to plug into a power outlet as the power source, the battery source automatically actuating the nightlight upon failure of the plug-in mode of operation.

13. A nightlight assembly comprising:

a wall plate adapted to fit over a power switch extending from a substantially planar surface, the wall plate including an optical assembly for focusing and dispersing LED emitted light to a desired light contour, the wall plate abutting and engaging the substantially planar surface upon mounting the nightlight-in its final operating position and at least one light emitting diode (LED) mounted within the wall plate serving as the light source for the nightlight.

14. The nightlight assembly according to claim 13, wherein the optical assembly is selectively adjustable for focusing and dispersing the LED emitted light.

15. The nightlight assembly according to claim 13, wherein the optical assembly is fixed and the LED serving as the light source is selectively moveable for focusing and dispersing the LED emitted light.

16. The nightlight assembly according to claim 13, wherein the wall plate has a switch toggle opening for receiving the power switch extending from the substantially planar surface.

17. The nightlight assembly according to claim 13, wherein a plurality of LEDs are mounted within the housing having multiple colors of spectral output.

18. The nightlight assembly according to claim 13, further comprising printed wiring mounted in the housing electrically coupling the LED to the power switch.

19. The nightlight assembly according to claim 13, further comprising a switch coupled to a variable resistor for controlling the level of optical output.

20. The nightlight assembly according to claim 19, wherein the switch is adapted to selectively turn on and off any select number of the at least one LED.

21. The nightlight assembly according to claim 19, wherein the switch operates as a step level variable control having at least two distinct levels of illumination.

22. The nightlight assembly according to claim 19, wherein the switch operates as a rheostat having continuous variable control.

* * * * *